US007258297B2

(12) United States Patent
Liu

(10) Patent No.: US 7,258,297 B2
(45) Date of Patent: Aug. 21, 2007

(54) REEL ASSEMBLY FOR A VENETIAN BLIND

(76) Inventor: Tai-Ping Liu, No. 18, Alley 8, Lane 3, Kuo-Chi St., Lung-Ching Hsiang, Taichung Hsien (TW)

( * ) Notice: Subject to any disclaimer, the term of this patent is extended or adjusted under 35 U.S.C. 154(b) by 299 days.

(21) Appl. No.: 11/009,629

(22) Filed: Dec. 10, 2004

(65) Prior Publication Data

US 2006/0124797 A1 Jun. 15, 2006

(51) Int. Cl.
*B65H 75/44* (2006.01)

(52) U.S. Cl. ..... 242/398; 160/177 R; 160/176.1 R

(58) Field of Classification Search ..... 242/398; 160/176.1 R, 177 R, 178.1 R
See application file for complete search history.

(56) References Cited

U.S. PATENT DOCUMENTS 2,721,609 A * 10/1955 Rutledge ..... 160/177 R
3,333,905 A * 8/1967 Hennequin ..... 384/440
4,333,510 A * 6/1982 Fox ..... 160/177 R
4,457,351 A * 7/1984 Anderson ..... 160/178.1 R
5,341,865 A * 8/1994 Fraser et al. ..... 160/176.1 R
5,497,820 A * 3/1996 Drake, III ..... 160/107
5,538,066 A * 7/1996 Liu ..... 160/173 R
6,095,228 A * 8/2000 Liu ..... 160/173 R
D438,045 S * 2/2001 Liu ..... D6/580
6,189,596 B1 * 2/2001 Chen ..... 160/176.1 R
6,588,481 B1 * 7/2003 Hsu ..... 160/173 R
7,028,739 B2 * 4/2006 Hsu ..... 160/173 R

* cited by examiner

*Primary Examiner*—Gene O. Crawford
*Assistant Examiner*—Sang Kim
(74) *Attorney, Agent, or Firm*—Alan Kamrath; Kamrath & Associates PA

(57) ABSTRACT

A reel assembly includes a bracket and a reel pivotally received in the bracket. The bracket has a slanted face formed on a top face of the sidewall to be adjacent to the cutout for facilitating receiving of the extensions in the cutouts. A supporting arm is formed on a side face of the sidewall and has two steps formed on a top face of the supporting arm to increase load capability of the supporting arm. An inclined edge and an arcuate corner are formed on an inner face defining the through hole so that when a strip is extended through the through hole, friction to the strip by the inner face defining the through hole is reduced.

2 Claims, 4 Drawing Sheets

REEL ASSEMBLY FOR A VENETIAN BLIND

BACKGROUND OF THE INVENTION

1. Field of the Invention

The present invention relates to a reel assembly for a Venetian blind and, more particularly, to a reel assembly composed of a bracket and a reel pivotally received in the bracket. The bracket has a cutout defined in a top face of each of two opposed sidewalls, a slanted face inclined relative to the top face of the sidewall and a through hole defined in a bottom of the sidewall such that when two extensions are to be respectively received in the two cutouts, the slanted faces facilitate combination between the two extensions and the cutouts. Further, an oblique edge is formed on an inner face defining the through hole so that friction between the oblique edge and the strip is reduced.

2. Description of Related Art

With reference to FIG. 4, it is noted that a conventional reel assembly is composed of a bracket (4) and a reel (5) pivotally received in the bracket (4).

The bracket (4) has two opposed sidewalls (41) integrally connected to each other via a base (42). Each sidewall (41) is provided with a cutout (411) which is defined in a top portion of the sidewall (41), an arm (412) formed on a side face defining the cutout (411) and on top of the cutout (411), and a through hole (413) defined in a bottom portion of the sidewall (41) for extension of a strip A. The base (42) further has an aperture (421). The reel (5) has a crossbar (6) securely extending out from opposite sides of the reel (5) to be received and retained in the two cutouts (411) of the bracket (4) by the arms (412).

From the operational perspective viewpoint, it is appreciated that when the crossbar (6) is pivoted in the cutouts (411), friction between the crossbar (6) and a side face defining the cutout (411) wears out the crossbar (6) and the side face of the cutout (411). Eventually, the pivotal movement of the reel (5) is terminated. Furthermore, when the strip is extended through the through hole (413), friction with the side face defining the through hole (413) gradually wears out the strip and then the strip breaks.

To overcome the shortcomings, the present invention tends to provide an improved reel assembly to mitigate the aforementioned problems.

SUMMARY OF THE INVENTION

The primary objective of the present invention is to provide a reel assembly having a bracket and a reel pivotally received in the bracket. The bracket has a slanted face formed adjacent to the cutout and an inclined edge with an arcuate corner formed on an inner face defining the through hole such that friction between both the bracket and strip is reduced and thus the life span of the reel assembly is prolonged.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
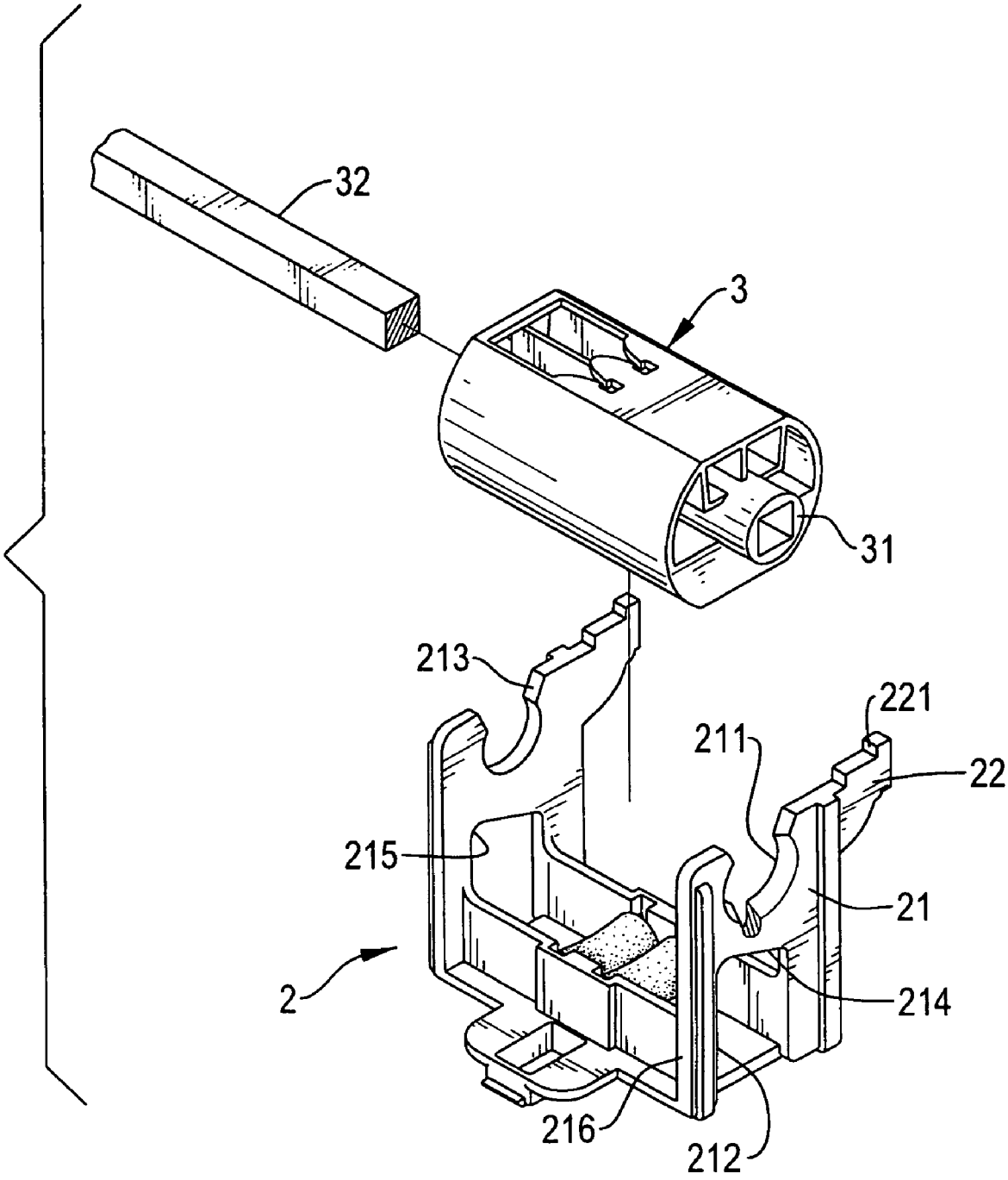
FIG. 1 is an exploded perspective view of the reel assembly of the present invention.

With reference to FIG. 1, the reel assembly in accordance with the present invention includes a bracket (2) and a reel (3) pivotally received in the bracket (2).

The bracket (2) is composed of two sidewalls (21) integrally formed with each other and each sidewall (21) has a supporting arm (22) extending from a side of the sidewall (21). Each sidewall (21) has a cutout (211) defined in a top portion of the sidewall (21) and a through hole (212) defined in a bottom portion of the sidewall (21). A slanted face (213) is formed adjacent to the cutout (211) relative to a top face of the sidewall (21). An inclined edge (214) is formed on an inner face of the through hole (212) and an arcuate corner (215) is formed adjacent to the inclined edge (214). Furthermore, each supporting arm (22) has two steps (221) formed on a top face of the supporting arm (22).

The reel (3) has two extensions (31) formed on two opposed sides of a body of the reel (3) and a crossbar (32) extending through the body and protruding from the two extensions (31).

Figure 2:
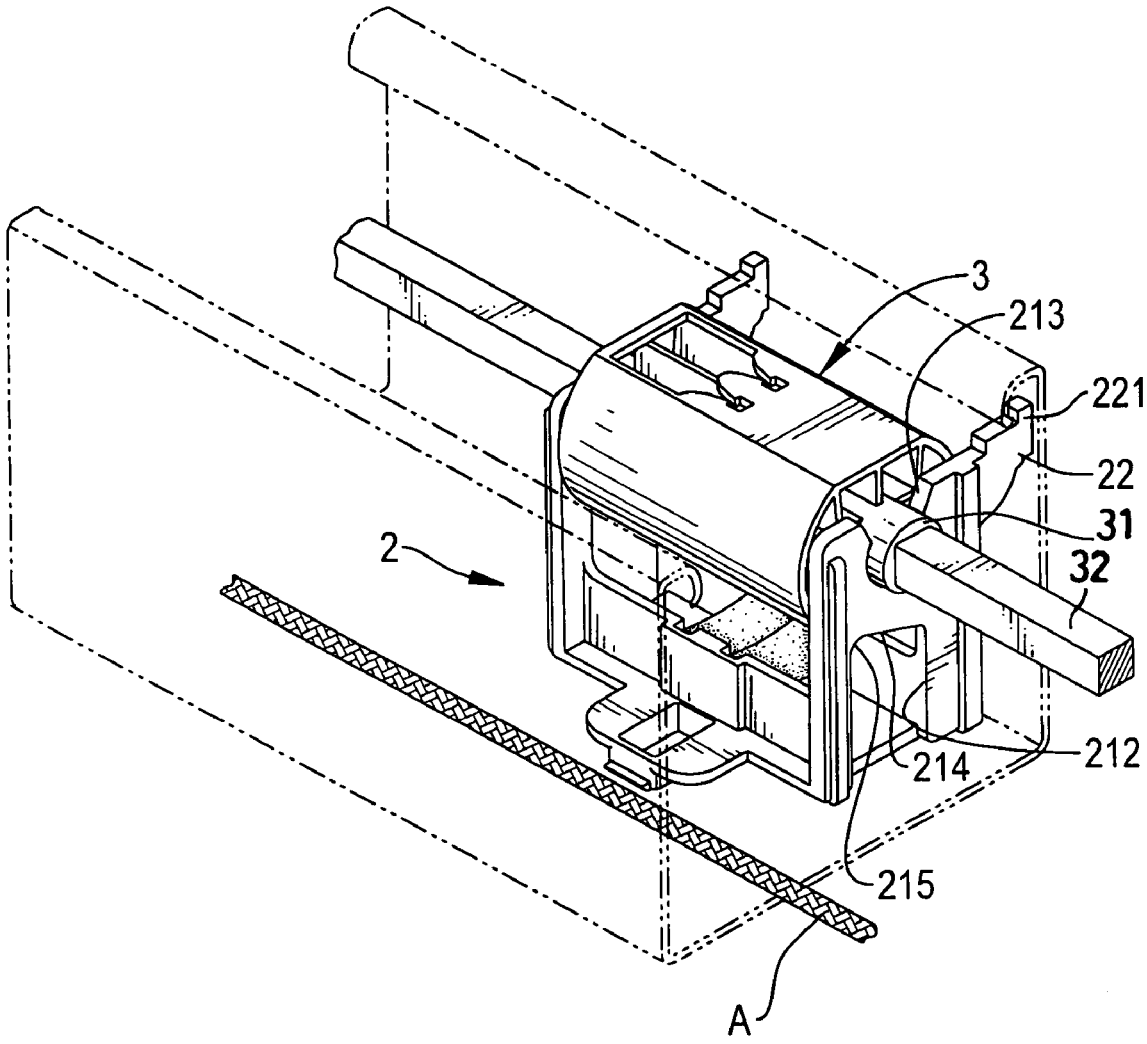
FIG. 2 is a perspective view showing that the reel assembly in FIG. 1 is assembled with the reel pivotally received in the bracket.

With reference to FIG. 2, it is noted that when the reel assembly of the present invention is to be assembled, the two extensions (31) of the reel (3) are engaged with the two slanted faces (213) so that the two extensions (31) are smoothly slid into the two cutouts (211). That is, the provision of the slanted faces (213) facilitates the combination between the cutout (211) and the extension (31). Furthermore, when a strip A extending from the reel (3) extends through the through hole (212), due to the inclined edge (214) and the arcuate corner (215), friction between the side face defining the through hole (212) and the strip is reduced. Still, the provision of the two steps (221) increases the durability of the supporting arm (22).

Figure 3:
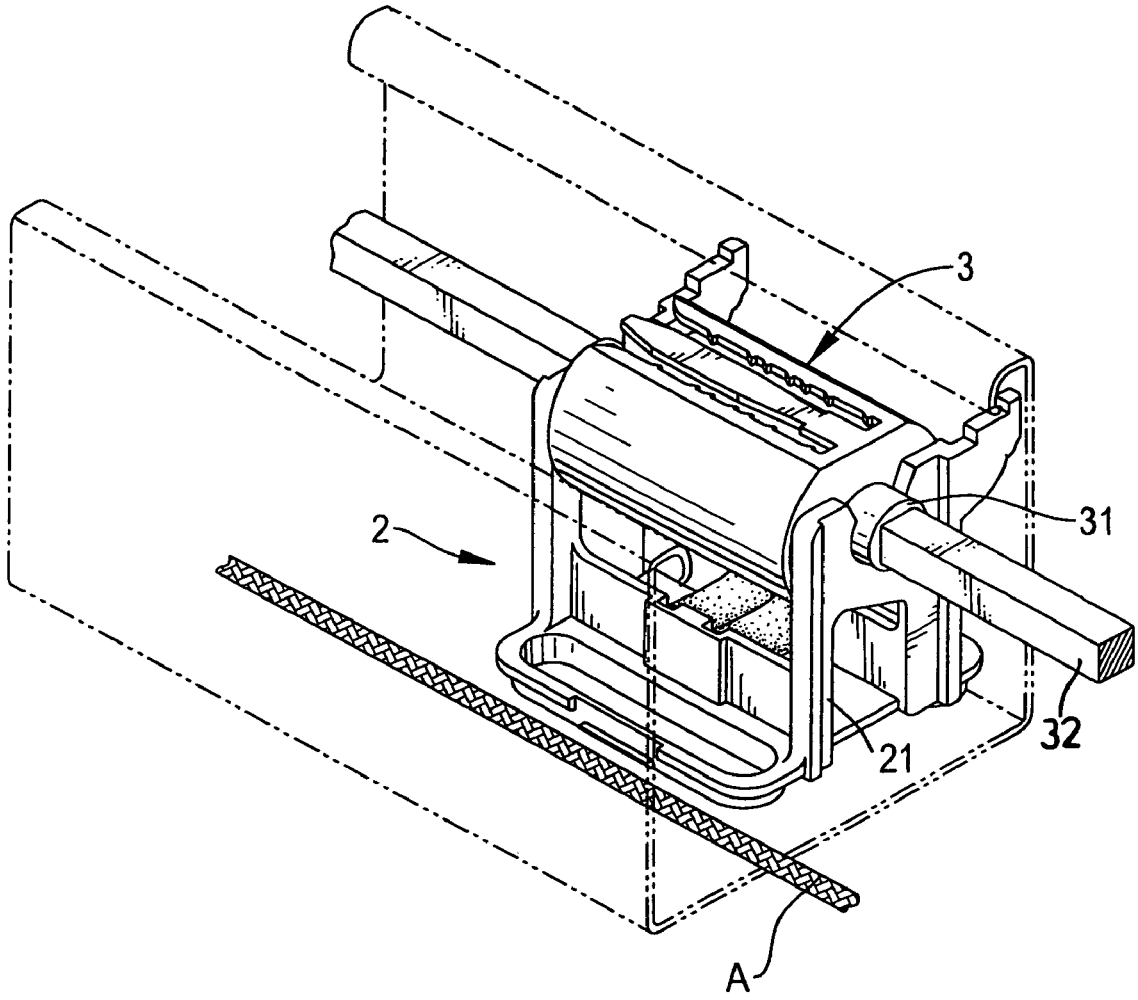
FIG. 3 is a perspective view showing the application of the reel assembly in a different embodiment.
Figure 4:
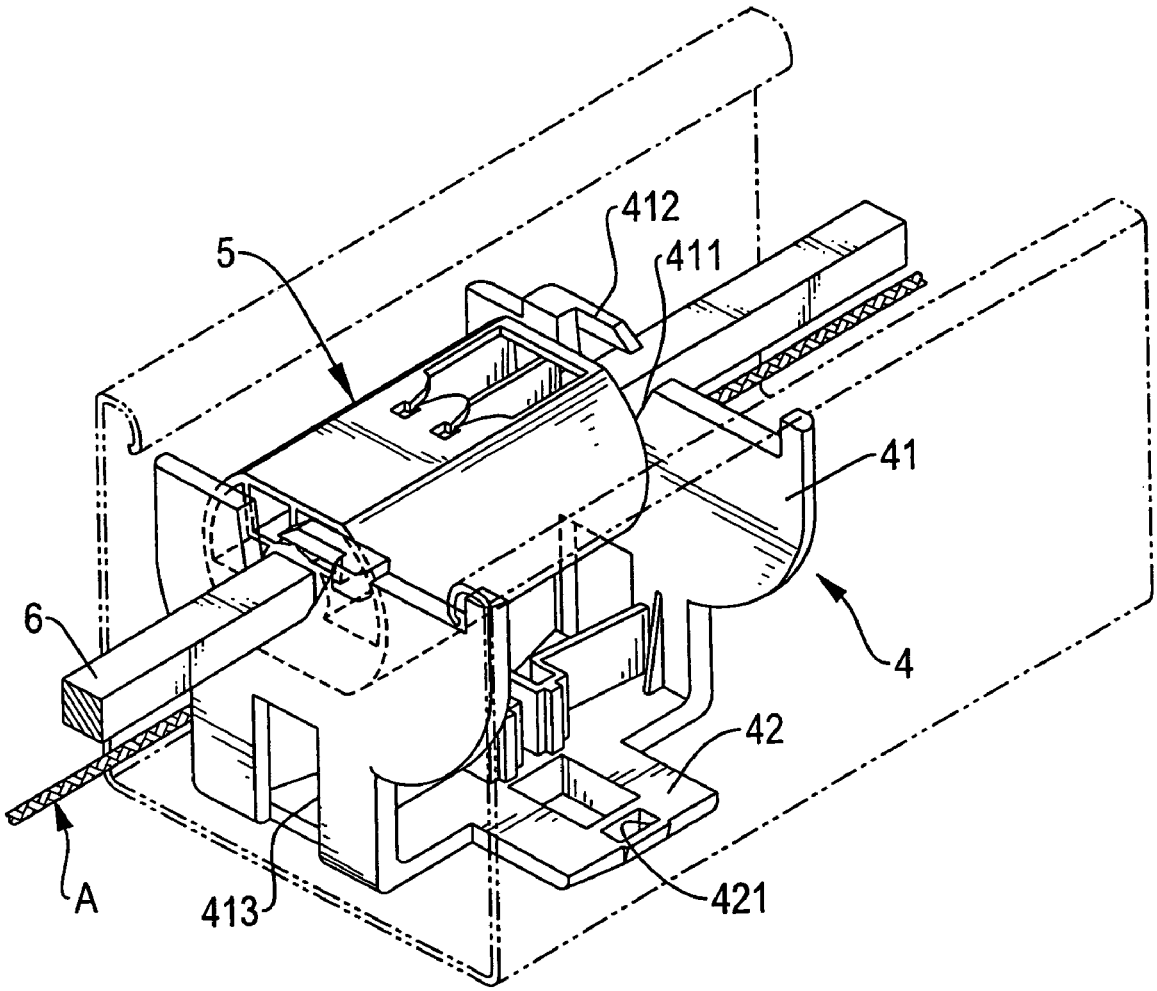
FIG.4 PRIOR ART
FIG. 4 is a perspective view showing a conventional reel assembly for the Venetian blind.

With reference to FIG. 3, it is noted that when the reel assembly of the present invention is applied to a different embodiment where a side hole in FIG. 1 is changed to an elongated hole in FIG. 3 for extension of a cloth (not shown). It is appreciated that no matter what kind of venetian blind is applied, the reel assembly is able to accomplish the designed goals.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A reel assembly comprising:

a bracket provided with two sidewalls each having a cutout defined in a top portion of the sidewall;

a through hole defined in a bottom portion of the sidewall by a continuous annular periphery; and a reel pivotally received in the bracket and having two extensions each oppositely formed on a side of the reel and a crossbar extending through the two extensions, wherein:

a slanted face relative to a top face of the sidewall is formed adjacent to the cutout for facilitating receiving of the extensions in the cutouts;

a supporting arm is formed on a side face of the sidewall and has two steps formed on a top face of the supporting arm to increase load capability of the supporting arm;

the continuous annular periphery includes an inclined edge and an arcuate corner formed on an inner face defining the through hole, whereby when a strip is extended through the through hole, friction to the strip by the inner face defining the through hole is low, and the strip is confined by the continuous annular periphery of the through hole.

2. The reel assembly as claimed in claim 1, wherein the two sidewalls upstand from a base, wherein the continuous annular periphery includes a lower edge defined by the base, and wherein the continuous annular periphery includes first and second side edges extending between the lower edge and the inclined edge, with the first side edge being longer than the second side edge, with the arcuate corner defined between the inclined edge and the first side edge.

* * * * *